United States Patent [19]

Yamazaki et al.

[11] 4,193,749

[45] Mar. 18, 1980

[54] SCREW BLOWER

[75] Inventors: Shuichi Yamazaki, Kamifukuoka; Keisuki Ban, Fujimi, both of Japan

[73] Assignee: Honda Giken Kogyo Kabushiki Kaisha, Tokyo, Japan

[21] Appl. No.: 870,255

[22] Filed: Jan. 17, 1978

[30] Foreign Application Priority Data

Jan. 27, 1977 [JP] Japan ..... 52/7994

[51] Int. Cl.[2] ..... F04C 1/10

[52] U.S. Cl. ..... 418/201

[58] Field of Search ..... 418/201; 73/261

[56] References Cited

U.S. PATENT DOCUMENTS

| | | | |
|---|---|---|---|
| 1,459,552 | 6/1923 | Rathman | 418/201 X |
| 2,745,392 | 5/1956 | Nallinger | 123/119 C |
| 2,843,094 | 7/1958 | Berck | 418/201 X |
| 3,164,099 | 1/1965 | Iyoi | 418/201 |

FOREIGN PATENT DOCUMENTS

| | | | |
|---|---|---|---|
| 129730 | 11/1976 | Austria | 73/261 |

*Primary Examiner*—Leonard E. Smith

*Attorney, Agent, or Firm*—Haseltine, Lake & Waters

[57] ABSTRACT

A screw blower comprising a pair of rotary driving shafts disposed in parallel relation and a pair of rotors rotatable with the driving shafts. The rotors are provided with meshing teeth each having a helix angle. A casing surrounds the rotors and forms therewith an intake chamber and an exhaust chamber. Grooves, which are formed between the meshing teeth, come into communication with an opening of the exhaust chamber as the rotors undergo rotation. The opening of the exhaust chamber extends over the full length of the rotors. Each of the rotors has a predetermined number of teeth and a sufficiently large helix angle such that gases trapped within the grooves are immediately discharged to the exhaust chamber without being compressed as the rotors rotate. The opposedly disposed meshing teeth are meshed in a male and female relationship.

6 Claims, 11 Drawing Figures

SCREW BLOWER

BACKGROUND OF THE INVENTION

1. Field of the Invention

The present invention relates to screw blowers and particularly to a screw blower for use with an internal combustion engine as a supercharger, to form a continuous exhaust flow, with minimal pulsation and smooth operation, and which can be operated at high efficiency with minimal power loss and torque fluctuation over a wide range of operating speeds from low speed to high speed. The blower is easily machined, and can be manufactured as a small and lightweight unit.

2. Description of the Prior Art

A blower or compressor is used as a means to feed gases, such as air or air-fuel mixture under pressure when supercharging is effected in order to increase the volumetric efficiency of the engine or when secondary air is supplied for purifying the exhaust gases. The conventional construction of a blower or compressor of this kind includes speed types including a centrifugal blower, an axial flow blower and the like, and volumetric types including a vane blower, a Roots blower, a screw blower and the like. In the blower or compressor, the speed type is suitable for operation at high speeds but is poor in efficiency at low speeds. Additionally, due to limitations in reductions in size and weight, application of the speed type is limited to specific fields. As regards the volumetric types, the vane type and the Roots type are suitable for low pressure compression and are high in efficiency at low speeds but are low in efficiency at high speeds, thus being unsuitable for high pressure compression. In addition, during operation, pulsations are liable to occur to produce noise, and the driving horse power and torque greatly fluctuate.

Additionally, in the screw type blower or compressor, the compression ratio can be selected easily, the efficiency during operation at high speed and high pressure is high, both suction and exhaust are continuous, pulsations are minimal and noise is also low. Fluctuation in driving horse power and torque is also small.

SUMMARY OF THE INVENTION

It is an object of the present invention to make use of the advantages of a conventional screw type blower or compressor and to improve the same to provide a screw blower, which forms a continuous exhaust flow, produces less pulsation because of smooth operation, can be operated at high efficiency with minimal power loss and torque fluctuation over a wide range of operating speeds from low speeds to high speeds. Furthermore, the improved screw blower can be easily machined, can be manufactured as a small lightweight unit and can be effectively employed either for supercharging the engine or supplying secondary air.

BRIEF DESCRIPTION OF THE DRAWINGS

The present invention will be more clearly understood from the following description when read in connection with the accompanying drawings, in which.

DESCRIPTION OF THE PREFERRED EMBODIMENT

Figure 1:
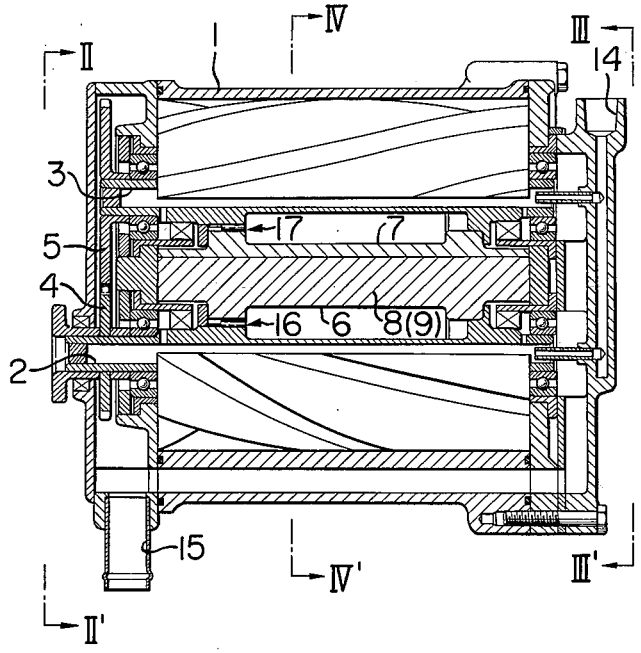
FIG. 1 is a longitudinal sectional view of a screw blower according to a preferred embodiment in accordance with the present invention.
Figure 2:
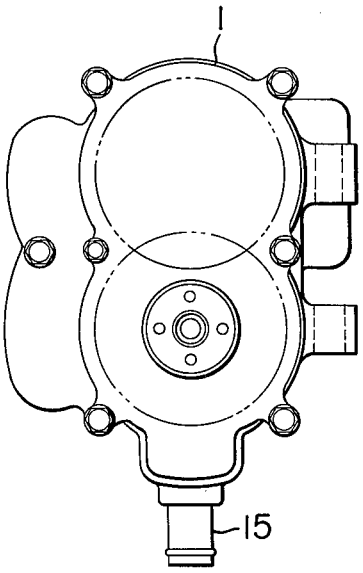
FIG. 2 is an end view of the screw blower taken on line II–II' in FIG. 1.
Figure 3:
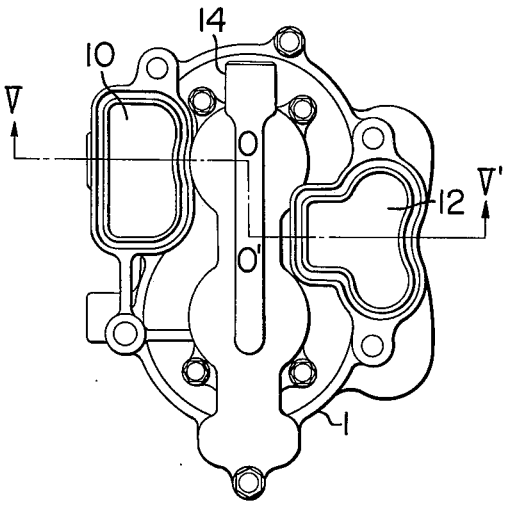
FIG. 3 is an end view of the screw blower taken on line III–III' in FIG. 1.

Referring to FIGS. 1 to 5, therein is shown a casing 1 having end walls between which a pair of hollow rotary driving shafts 2 and 3 are rotatably supported in bearings in parallel relation and driven in opposite directions. A timing gear 4 secured to the end of the rotary driving shaft 2 and a timing gear 5 secured to the end of the rotary driving shaft 3 are in mesh with one another so that the rotary driving shafts 2 and 3 are rotatably driven in opposite directions in correspondence with one another.

An inner peripheral portion of a rotor 6 formed on its outer peripheral surface with meshing teeth 8 is mounted on the outer peripheral surface of the rotary driving shaft 2, and the rotary driving shaft 2 and the rotor 6 are engaged with one another through a spline 16 so that the rotor 6 is rotated with the rotary driving shaft 2.

Similarly, an inner peripheral portion of a rotor 7 formed on its outer peripheral surface with meshing teeth 9 is mounted on the outer peripheral surface of the rotary driving shaft 3, and the rotary driving shaft 3 and the rotor 7 are engaged with one another through a spline 17 so that the rotor 7 is rotated with the rotary driving shaft 3.

Figure 4:
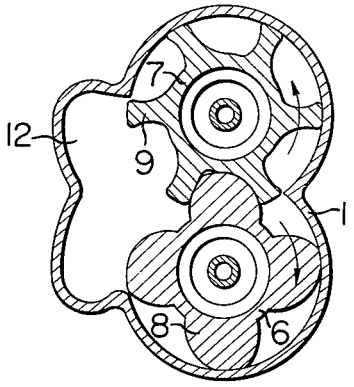
FIG. 4 is a transverse sectional view of the screw blower taken on line IV–IV' in FIG. 1.
Figure 5:
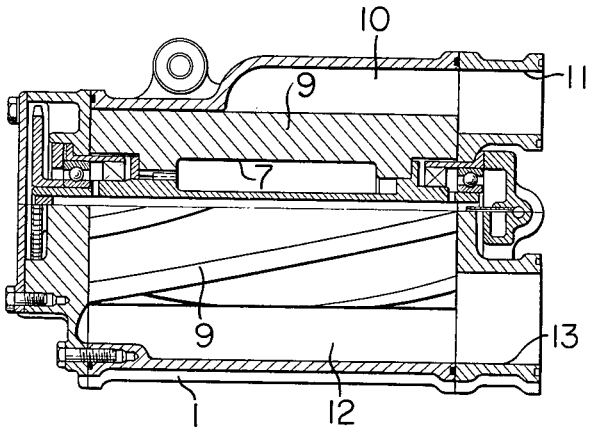
FIG. 5 is a longitudinal sectional view of the screw blower taken on line V–O–O'–V' in FIG. 3.

As particularly shown in FIG. 4, the rotor 6 has four meshing teeth 8 and the rotor 7 has six meshing teeth 9, the meshing teeth 8 having a sectional contour in the form of a male projection whereas the meshing teeth 9 having a sectional contour in the form of a female recess so that the latter may be closely engaged with the meshing teeth 8. Furthermore, as shown in FIGS. 1 and 5, each of the meshing teeth 8 and 9 has a reversely directed relatively small helix angle.

The present invention is particularly characterized in that each of the rotors has a predetermined number of teeth having a sufficiently large helix angle so that gases trapped within grooves between the teeth on the intake side are immediately discharged to the exhaust side without being compressed in a leading direction, and the meshing teeth opposed to each other are in meshed contact in a male and female relationship.

The teeth 8 may be three in number whereas the teeth 9 may be four in number instead of the illustrated arrangement in which the teeth 8 are four in number whereas the teeth 9 are six in number.

When the rotary driving shaft 2 is connected to a suitable driving means, the rotors 6 and 7 are respectively rotated in directions as indicated by the arrows in FIG. 4. On the side in which the meshing teeth 8 and 9 are disengaged i.e. the right side in FIG. 4, an intake chamber 10 in communication with an intake pipe 11 is formed, and on the side in which the meshing teeth 8 and 9 are engaged i.e. the left side in FIG. 4, an exhaust chamber 12 in communication with an exhaust pipe 13 is formed. As shown in FIG. 5, an open portion of the exhaust chamber 12 extends over the full length of the rotors 6 and 7. This arrangement facilitates the discharge of exhaust gases and prevents creation of a state in which gases are locally confined to form a high pressure, as a consequence of which the volumetric efficiency would be decreased and pulsation would be generated.

The outer peripheral portions of the rotors 6 and 7 with the exception of the open portion of the intake chamber 10 and the open portion of the exhaust chamber 12 are surrounded in air-tight relationship by the casing 1 which has a cylindrical inner peripheral surface. Therefore, the gases within the intake chamber 10 are trapped within gaps formed by the grooves between the adjacent teeth in the meshing teeth 8 and 9 and the inner walls of the casing 1, and the gases are rotated from the open portion of the intake chamber 10 to the open portion of the exhaust chamber 12 without being compressed in the leading or advancing direction, and thereafter, the gases are urged into the exhaust chamber 12 during the meshing of the teeth 8 and 9 with each other in the open portion of the exhaust chamber 12.

At one end of the casing 1 there is provided a port 14 through which lubricating oil is introduced, and the lubricating oil introduced through the port 14 lubricates the rotating portions at said one end and passes through a hollow bore within the rotary driving shafts 2 and 3 to lubricate the rotating portions at the other end thereof and is then discharged through an outlet 15.

Figure 6:
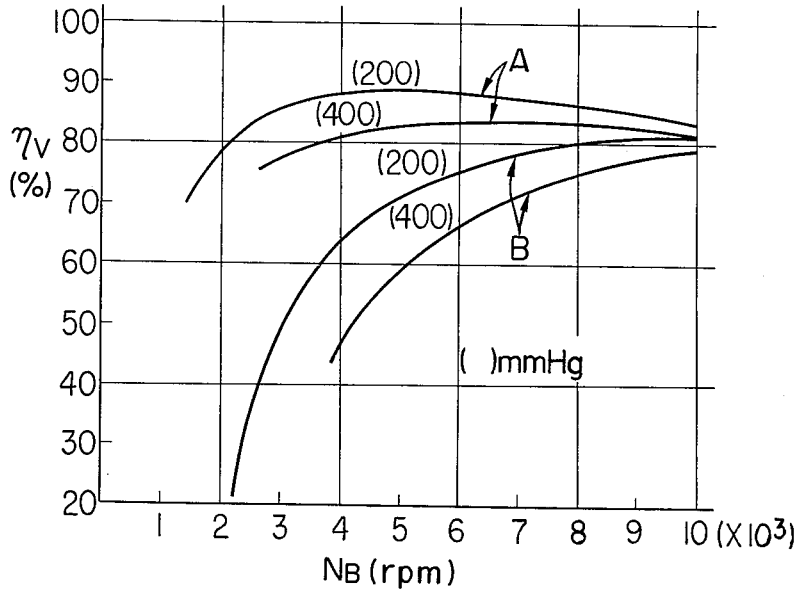
FIG. 6 shows characteristic curves of volumetric efficiency comparing the screw blower according to the present invention with a conventional screw-type blower.

FIG. 6 is a graph which shows volumetric efficiency characteristics with respect to the screw blower according to the present invention and a conventional screw-type blower in which the intake and exhaust chambers are not formed to prevent gas compression as in the present invention. The outside diameters of the rotors for the respective blowers used for measurement are 80 mm, and the capacities of feed air are 450 cc/rev of the rotors. In FIG. 6, the abscissa represents the rotational speed $N_B$ (rpm) of the rotor, and the ordinate represents the volumetric efficiency $\eta_v$ (%). Curves A are the volumetric efficiency characteristics of the screw blower in accordance with the present invention, and curves B are the volumetric efficiency characteristics of the conventional screw-type blower.

Measurements were conducted for cases where the gas pressures within the intake chamber are 200 mmHg and 400 mmHg. Corresponding gas pressures within the intake chambers are shown in parentheses adjacent the respective curves.

As is apparent from FIG. 6, it is found that as compared to the conventional screw-type blower, the screw blower of the present invention has extremely high volumetric characteristics particularly at low speeds, and the effect obtained therefrom is great, particularly at the time of operation under low pressure, the volumetric efficiency from the low speed zone to the high speed zone being substantially flat.

Figure 7:
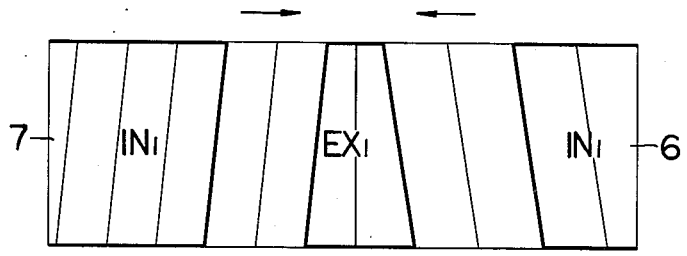
FIG. 7 is a development view of the teeth of male and female rotors of the inventive blower shown in FIGS. 1 to 5 and employed in FIG. 6, illustrating the relationship of the rotor teeth to the opening portion of intake and exhaust chambers of the blower.

FIG. 7 illustrates in a developed form the relationship of the teeth of the intermeshing male and female rotors 6 and 7 of the inventive blower according to the present invention shown in FIGS. 1 to 5 and employed in FIG. 6 to the respective open portions $IN_1$ and $EX_1$ of the intake and exhaust chambers 10 and 12. In this figure, arrows indicate the rotating directions of the rotors 6 and 7. The specification of the rotors 6 and 7 illustrated is as follows:

| | |
|---|---|
| Outer Diameter of Male and Female Rotors: | 80 mm |
| Axial Length of Male and Female Rotors: | 152 mm |
| Helix Angle of Rotor Teeth: | 6° |
| Contact Ratio of Male and Female Rotors: | 0.4 |
| Displacement Volume: | 450 cc/rev |
| Gear Ratio of Male and Female Rotors: | 4:6 |

As illustrated in FIG. 7, the open portion $EX_1$ of the exhaust chamber 12 is formed large enough to extend over the entire axial length of the male and female rotors such that recesses formed between the adjacent teeth of each of the male and female rotors 6 and 7 come into communication with the open portion $EX_1$ of the exhaust chamber 12 before engagement of the corresponding teeth of the male and female rotors 6 and 7 or compression stroke takes place.

Figure 8:
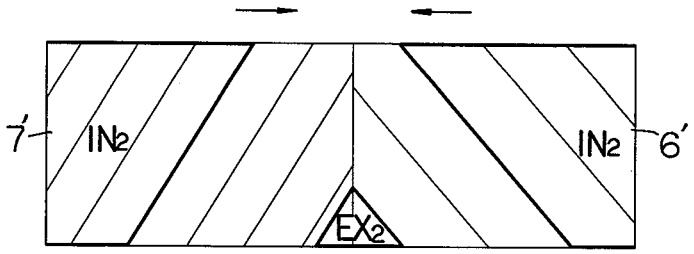
FIG. 8 is a view similar to FIG. 7 but of the conventional blower employed in FIG. 6.

FIG. 8 is a view similar to FIG. 7 but of the conventional screw blower employed in FIG. 6, in which an open portion $EX_2$ of an exhaust chamber is formed small to extend only a distance (40 mm) of about one-fourth of the axial length of male and female rotors 6' and 7' such that recesses formed between the adjacent teeth of the rotors are initially out of communication with the exhaust opening $EX_2$ at the initial stage of meshing engagement of the rotor teeth or compression stroke and maintained thereafter in this state for the period of about three-fourths of the compression stroke and then placed into communication with the exhaust opening $EX_2$ only at the last stage of the compression stroke, namely for a period of about one-fourth of the entire compression stroke. In this illustration, reference character $IN_2$ indicates an open portion of an intake chamber and arrows indicate the rotating directions of the rotors 6' and 7'. The specification of the conventional blower illustrated is the same as that of the inventive blower as referred to in connection with FIG. 7 except for the following:

| | |
|---|---|
| Helix Angle of Male and Female Rotors: | 30° |
| Contact Ratio of Male and Female Rotors: | 2.0 |

Figure 9:
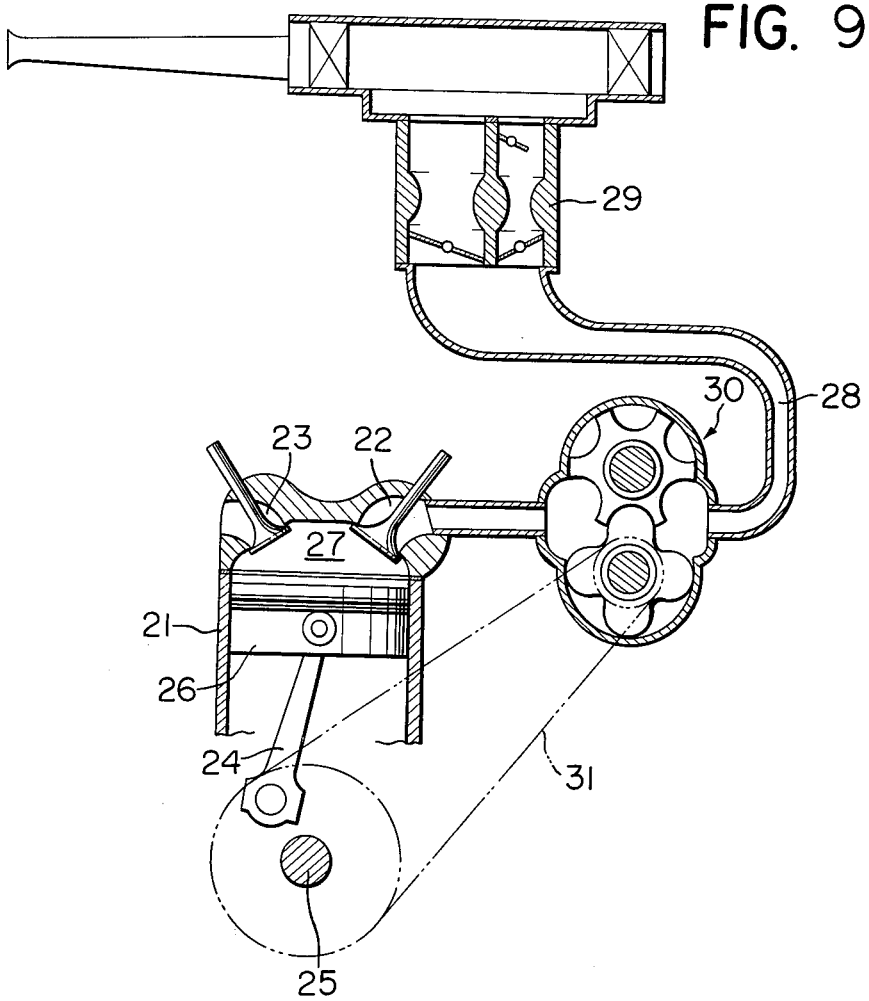
FIG. 9 is a schematic longitudinal sectional view showing an embodiment of an engine employing the screw blower according to the invention as a supercharger.

FIG. 9 shows an embodiment in which the screw type blower of the present invention is used as a supercharger for an internal combustion engine. In this figure, there is shown an engine body 21 provided with an intake port 22 and an exhaust port 23 at the upper part thereof, the engine body slidably receiving therein a piston 26 coupled to a crank shaft 25 through a piston rod 24, the piston 26 defining a combustion chamber 27. The intake port 22 communicates with a mixture forming means 29, such as a carbureter, via an intake passage 28. In the intake passage 28 there is interposed downstream of the mixture forming means 29 a supercharger 30 comprised of the screw-type blower according to the present invention, the supercharger 30 being driven from the crank shaft 25 through a transmission mechanism 31 such as a chain and sprockets. With this arrangement, the mixture discharged from the mixture forming means 29 into the intake passage 28 is extremely efficiently accelerated by blower 30 without being compressed at all and the mixture is fed into the combustion chamber 27 through the intake port 22, whereby supercharging of the engine takes place.

Figure 10:
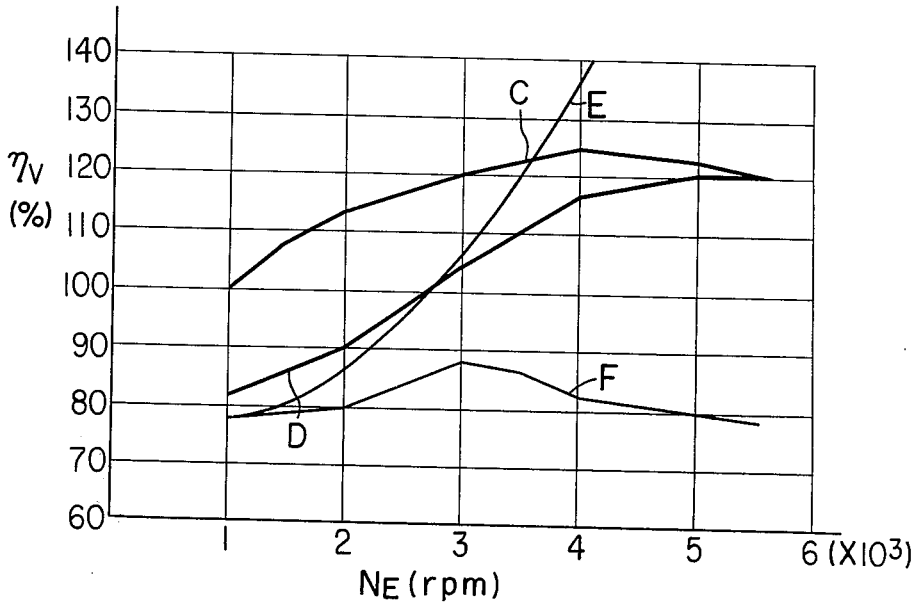
FIG. 10 shows characteristic curves of supercharging comparing the engine shown in FIG. 9 with engines respectively employing a conventional screw-type blower and a centrifugal-type blower as a supercharger, and also with a conventional internal combustion engine unprovided with any particular supercharging means.

FIG. 10 is a graph showing the supercharging characteristics of engines, in which curves C, D and E respectively show the supercharging characteristics of engines employing, as the supercharger, the screw-type blower of the present invention, a conventional screw-type blower and a centrifugal pump, and curve F shows the supercharging characteristic of a conventional internal combustion engine unprovided with any particular supercharging means. In this graph, the ordinate and abscissa represent the volumetric efficiency $\eta_v$ (%) and the rotational speed $N_E$ (r.p.m.), respectively. As may be seen in FIG. 10, as compared to the engine provided with the conventional blower and to the engine unprovided with any particular supercharger, the engine provided with the screw-type blower according to the present invention is extremely high in volumetric efficiency, which tendency is notable particularly in the region of low speeds of the engine, and as a whole, the magnitude of fluctuation from the region of low speed rotation to the region of high speed rotation is relatively small, obtaining a volumetric efficiency characteristic of the engine which is almost flat, whereas the volumetric efficiency of the engine provided with the centrifugal pump is very low in the low speed range and rises abruptly from the intermediate speed range to the high speed range, as a consequence of which control of the volumetric efficiency in these speed ranges is very difficult and hence such centrifugal pump is not suitable for the usual operation of the engine.

Figure 11:
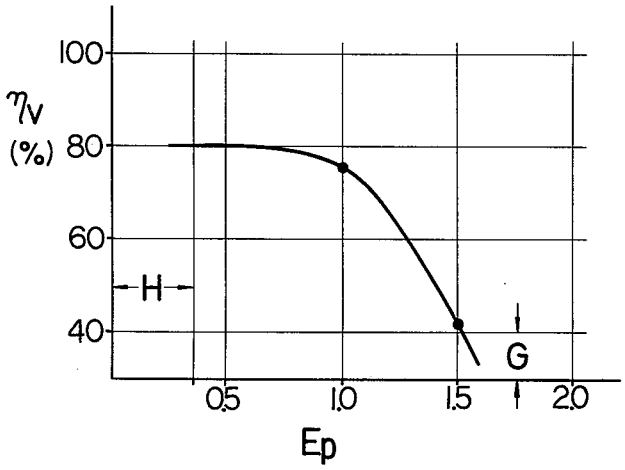
FIG. 11 is a graphic representation showing the relationship between the volumetric efficiency of the engine provided with the inventive blower and the contact ratio of the male and female rotors.

FIG. 11 shows in a graphic form the relationship between the volumetric efficiency $\eta_v$ of the engine provided with the inventive blower and the contact ratio Ep of the male and female rotors. In this figure, reference character G represents a general range of volumetric efficiency of the engine provided with the conventional blower in which the volumetric efficiency is very low (equal to or less than 40%) and reference character H represents a discontinuous flow range in which air flow discharged from the blower is not continuous but of the pulsative nature. From this graph, it is evident that the volumetric efficiency $\eta_v$ of the inventive blower is generally higher than that of the conventional blower in the range of contact ratio Ep equal to or less than 1.5 and it is particularly high (nearly 80%) in the range of contact ratio Ep less than about 1.0.

Although not shown, it should be noted in the embodiment of FIG. 7 that the intake passage 28 may incorporate a by-pass disposed in parallel with the supercharger 30 in a manner such that the by-pass may be suitably opened and closed.

As described above, the present invention basically makes the best use of the advantages of the conventional screw-type blower and at the same time provides an arrangement wherein the grooves formed between the meshing teeth 8 and 9 during the rotation of the rotors 6 and 7 are brought into communication with the opening portion of the exhaust chamber 12 when the grooves start compression stroke. Thus, the gases trapped within one groove are always continuously discharged into the exhaust chamber 12 without being compressed in the advancing or screwing direction. In addition, the opposedly disposed meshing teeth 8 and 9 are placed in meshed contact in male and female relationship to prevent leakage of gas between the front and the back in the meshed portion and an extremely higher volumetric efficiency is maintained compared to the conventional screw-type blower. Furthermore, a high efficiency operation can be achieved with less power loss and torque fluctuation over a wide range of running speeds from low speeds to high speeds. Accordingly, the present invention is effectively applied to blowers particularly for the supercharging of the engine and for the supply of secondary air for the recombustion of exhaust gases. Moreover, the meshing teeth 8 and 9 may be easily machined because there is merely provided a helix angle small enough to allow the teeth to effect continuous engagement with each other.

Furthermore, the opening portion of the exhaust chamber 12 extends over the full length of the rotors to thereby further facilitate discharge of exhaust flow and further increase the volumetric efficiency, while preventing pulsation.

Moreover, since the screw-type blower efficiently accelerates a mixture without compression and has a substantially flat volumetric efficiency with a small fluctuation over wide engine operations from a low speed zone to a high speed zone, it can be used as a supercharger for the internal combustion engine and it is possible to obtain a supercharging characteristic of the engine substantially flat from the low speed zone to the high speed zone thereby decreasing the magnitude of output fluctuation of the engine from the low speed zone to the high speed zone, thus providing a substantially flat output characteristic.

What is claimed is:

1. A screw blower comprising: a pair of rotary driving shafts disposed in parallel relation; means for rotatably driving the shafts in opposite directions; a pair of rotors having the same axial length secured to said shafts for rotation therewith, said rotors having respective teeth for meshing with one another; each of said teeth having a helix angle and meshing in male and female relationship with one another; an intake chamber for gases opening at the side of the teeth whereby the teeth disengage as the rotors rotate; an exhaust chamber for the gases opening at the side of the teeth, at which said teeth engage as the rotors rotate, the opening portion of said exhaust chamber extends over the entire length of said rotors; and a casing having a cylindrical inner peripheral surface surrounding said rotors in airtight slidably engaging relation, said casing being discontinuous at said opening of said intake chamber and said opening of said exhaust chamber, such that grooves formed between said meshing teeth come into communication with said opening of said exhaust chamber at the same time when said grooves start to compress gases trapped in said grooves.

2. A screw blower as claimed in claim 1 wherein said opening portion of the intake chamber extends over a portion of the length of the rotors.

3. A screw blower as claimed in claim 1 comprising means for lubricating said rotors.

4. A screw blower as claimed in claim 1 comprising a gas supply pipe connected to said intake chamber and a gas discharge pipe connected to said exhaust chamber.

5. A screw blower as claimed in claim 1 wherein the teeth of one of said rotors forms male projections and the teeth of the other of the rotors forms female recesses for meshing with the male projections.

6. A screw blower as claimed in claim 5 wherein said male projections have a rounded profile and said recesses are concave hollows.

* * * * *